US011554599B2

(12) United States Patent
Tanaka et al.

(10) Patent No.: US 11,554,599 B2
(45) Date of Patent: Jan. 17, 2023

(54) PRINTING APPARATUS

(71) Applicant: BROTHER KOGYO KABUSHIKI KAISHA, Nagoya (JP)

(72) Inventors: Mitsugi Tanaka, Nagoya (JP); Akito Uekihara, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/122,494

(22) Filed: Dec. 15, 2020

(65) Prior Publication Data

US 2021/0178787 A1 Jun. 17, 2021

(30) Foreign Application Priority Data

Dec. 16, 2019 (JP) ..... JP2019-226844
Mar. 2, 2020 (JP) ..... JP2020-034942

(51) Int. Cl.

| | |
|---|---|
| ***B41J 2/165*** | (2006.01) |
| ***B41J 29/13*** | (2006.01) |
| ***B41J 2/325*** | (2006.01) |
| ***B41J 11/00*** | (2006.01) |

(52) U.S. Cl.

CPC ..... *B41J 29/13* (2013.01); *B41J 2/16517* (2013.01); *B41J 2/325* (2013.01); *B41J 11/0015* (2013.01)

(58) Field of Classification Search

None

See application file for complete search history.

(56) References Cited

U.S. PATENT DOCUMENTS

2011/0063399 A1* 3/2011 Tsuchiya ..... B41J 2/32 347/222
2011/0115866 A1 5/2011 Izuma et al.
2015/0314616 A1* 11/2015 Shinjo ..... B41J 29/377 347/102
2016/0107465 A1* 4/2016 Tanaka ..... B41J 3/4075 347/110
2019/0018358 A1* 1/2019 Miyagawa ..... G03G 15/6555

FOREIGN PATENT DOCUMENTS

JP 2004031955 A * 1/2004 ..... B41J 29/13
JP 2004-306355 A 11/2004
JP 2005-265979 A 9/2005
JP 2011-093115 A 5/2011
JP 2011-126713 A 6/2011
JP 2012-096389 A 5/2012
JP 2013-147036 A 8/2013
JP 2014-058122 A 4/2014
JP 2016-078380 A 5/2016

* cited by examiner

*Primary Examiner* — Erica S Lin
*Assistant Examiner* — Tracey M McMillion
(74) *Attorney, Agent, or Firm* — Scully, Scott, Murphy & Presser, PC

(57) ABSTRACT

A printing apparatus includes: a printing unit which performs printing on a medium, a main body; a conveyer which conveys the medium; a post-processing unit which performs a post-processing for the medium on which the printing has been performed by the printing unit; a first cover rotatably supported by the main body and in which at least the post-processing part is installed; a second cover arranged to be adjacent to the first cover and supported by the main body such that the second cover is rotatable coaxially with the first cover; and an engaging mechanism which changes a state of the first cover and the second cover between an engaged state and a non-engaged state.

16 Claims, 11 Drawing Sheets

PRINTING APPARATUS

CROSS REFERENCE TO RELATED APPLICATION

The present application claims priorities from Japanese Patent Application Nos. 2019-226844, filed on Dec. 16, 2019 and 2020-034942, filed on Mar. 2, 2020, the disclosures of which are incorporated herein by reference in their entireties.

BACKGROUND

Field of the Invention

The present disclosure relates to a printing apparatus having an openable/closable cover.

Description of the Related Art

A printing apparatus such as a printer is provided with a cover which is openable/closable with respect to a main body of the printing apparatus. A user can perform maintenance for the inside of the main body, attachment of a print medium such as a sheet to the apparatus, etc., by opening the cover.

For example, there is a known printing apparatus provided with a downstream side opening/closing cover which opens/closes at the downstream side in a conveyance direction of a sheet and an upstream side opening/closing cover which opens/closes at the upstream side in the conveyance direction. The downstream side opening/closing cover and the upstream side opening/closing cover are provided so as to open individually from each other, with respect to the main body.

SUMMARY

In the above-described printing apparatus, both the downstream side opening/closing cover and the upstream side opening/closing cover are required to be opened so as to expose a conveying path of the sheet in a case of performing the maintenance for the inside of the main body. Further, also in a case of attaching a roll-shaped sheet to the printing apparatus, both the downstream side opening/closing cover and the upstream side opening/closing cover are required to be opened.

While the maintenance of the inside of the main body, such as handling of any jamming of the sheet in the conveying path, cleaning in the conveying path, etc., is not frequently performed, the attachment of the sheet is performed relatively frequently. Therefore, in the case of attaching the sheet, an operation of opening and closing the downstream side opening/closing cover and the upstream side opening/closing cover is troublesome for the user.

An object of the present disclosure is to provide a cover opening/closing mechanism which realizes satisfactory operability in both the case of performing the maintenance for the inside of the apparatus and the case of attaching the medium to the apparatus.

According to a first aspect of the present disclosure, there is provided a printing apparatus including: a printing unit configured to perform printing on a medium; a main body; a conveyer configured to convey the medium; a post-processing unit configured to perform a post-processing for the medium on which the printing has been performed by the printing unit; a first cover which is rotatably supported by the main body, and in which at least the post-processing unit is installed; a second cover arranged to be adjacent to the first cover, the second cover being supported by the main body such that the second cover is rotatable coaxially with the first cover; and an engaging mechanism configured to change a state of the first cover and the second cover between an engaged state and a non-engaged state, the engaged state being a state in which the first cover and the second cover are engaged with each other, the non-engaged state being a state in which the first cover and the second cover are disengaged.

According to a second aspect of the present disclosure, there is provided a printing apparatus including: a printing unit configured to perform printing on a medium; a main body; a conveyer configured to convey the medium; a post-processing unit configured to perform a post-processing for the medium on which the printing has been performed by the printing unit; a first cover which is rotatably supported by the main body, and in which at least the post-processing unit is installed; a second cover arranged to be adjacent to the first cover and rotatably supported by the first cover; and an engaging mechanism configured to change a state of the first cover and the second cover between an engaged state and a non-engaged state, the engaged state being a state in which the first cover and the second cover are engaged with each other, the non-engaged state being a state in which the first cover and the second cover are disengaged.

According to the first and second aspects of the present disclosure, it is possible to provide a cover opening/closing mechanism which realizes satisfactory operability in any one of the case of performing the maintenance for the inside of the printing apparatus, and the case of attaching the medium to the printing apparatus.

DESCRIPTION OF THE EMBODIMENTS

First Embodiment

A first embodiment of the present disclosure will be explained, with reference to FIGS. 1 to 8. First, the respective parts or components of a printing apparatus 100 will be explained.

Figure 1:
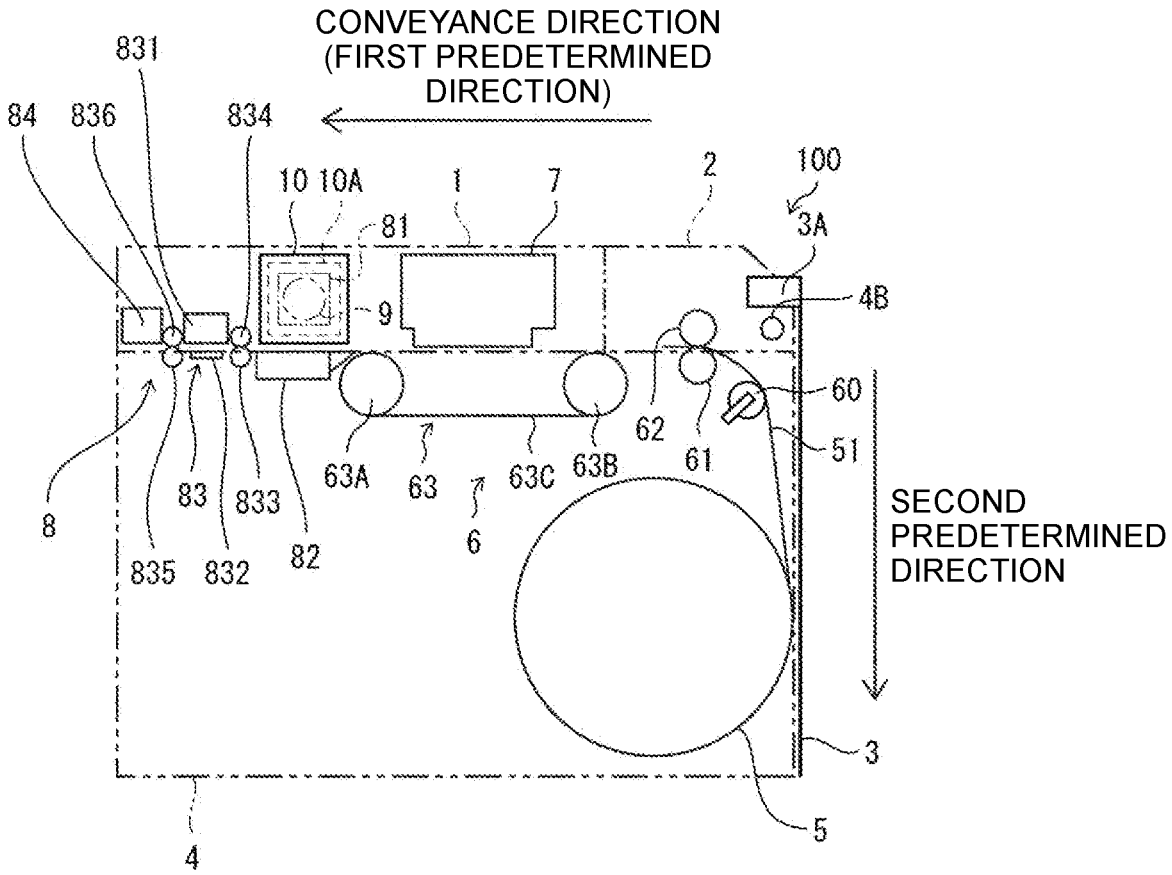
FIG. 1 is a side view depicting the inner configuration of a printing apparatus according to a first embodiment of the present disclosure.

The printing apparatus 100 as depicted in FIG. 1 is a label printer of an ink-jet printing system. As depicted in FIG. 1, the printing apparatus 100 includes a first cover 1, a second cover 2, a third cover 3, and a main body 4. Further, the printing apparatus 100 includes a roll paper holder 5, a conveyer 6, a head 7 as an example of a "printing unit", a post-processing unit 8, a fan 9 as an example of a "mist collecting mechanism", and a filter holding part 10.

The main body 4 is a casing having a part of the conveyer 6, the head 7, a part of the post-processing unit 8, etc., installed therein. The main body 4 accommodates a roll-paper holder 5 on a side of an end part of the main body 4. The roll paper holder 5 holds a roll paper 51 as an example of a "medium" and a "roll sheet". The roll paper holder 5 is driven to rotate by a motor (not depicted in the drawings) to thereby feed or send out the roll paper 51. The roll paper 51 is wound around the roll paper holder 5 in a roll shape.

As the medium, it is allowable to use cut paper and/or fan-folded paper, rather than using the roll paper. The medium is not being limited to paper, and may be a vinyl material, an electric base material, etc. In such a case that the medium is an electric base material, the printing apparatus 100 is configured to eject or discharge liquid containing a metal and to print a trace pattern of an electrical harness.

The first cover 1 and the second cover 2 are provided on the main body 4. The first cover 1 is supported to be rotatable with respect to the main body 4, by a rotational shaft 4B (see FIG. 2) provided on a rising part (upright part) 4A of the main body 4. The second cover 2 is also supported to be rotatable with respect to the main body 4 by the rotational shaft 4B. That is, the second cover 2 is supported to be rotatable with respect to the main body 4, coaxially with the first cover 1. The rising part 4A and the rotational shaft 4B will be explained in detail later.

Here, in each of embodiments including the first embodiment, an end part, of the printing apparatus 100 depicted in FIG. 1, on the downstream side in a conveyance direction in which the roll paper 51 is conveyed is defined as a front surface of the printing apparatus 100. Further, the explanation will be given on a premise that the first cover 1 and the second cover 2 are arranged on an upper part of the printing apparatus 100. However, the front surface, the upper and lower parts of the printing apparatus 100 are not limited to or restricted by this example.

In each of the first cover 1 and the second cover 2, an end part thereof in the conveyance direction, as an example of a "first predetermined direction", is pivotally supported with respect to the main body 4 by the rotational shaft 4B. This allows the postures of the first cover 1 and the second cover 2, respectively, to be changeable to a first posture in which the other end part in the conveyance direction of each of the first and second covers 1 and 2 is away from the main body and to a second posture in which the other end part in the conveyance direction of each of the first and second covers 1 and 2 is close to the main body 4 than that in the first posture. The first cover 1 and the second cover 2 are arranged side by side in the conveyance direction in which the rolled paper 51 is conveyed. Further, the first and second covers 1 and 2 and the main body 4 are arranged side by side in a second predetermined direction which is direction oriented from the lower side to the upper side.

The roll paper 51 is installed in the main body 4 so that an end part, of the roller paper 51, in the second predetermined direction (namely, a lower end part of the roll paper 51) is located on a side of a lower end part of the main body 4 with respect to (than) the center in the second predetermined direction of the main body 4. Further, the roll paper 51 is arranged side by side with respect to the second cover 2 in the second predetermined direction.

The conveyer 6 is a mechanism which conveys the roll paper 51 in the predetermined conveyance direction. The conveyer 6 has a tensioner 60, a conveying roller 61, a pressing roller 62 as an example of a "pressing mechanism", and a conveying belt mechanism 63. Note that the printing apparatus 100 may be provided with a conveyer which is configured only by a pair of conveying rollers, a conveyer which is configured only by a conveying belt, etc., instead of the above-described conveyer 6.

The conveying roller 61 is a roller which conveys the roll paper 51. The conveying roller 61 is rotatably supported by the main body 4, and is driven to rotate by a motor (not depicted in the drawings). The pressing roller 62 faces the conveying roller 61 at a predetermined position in an area in which the roll paper 51 is conveyed. The pressing roller 62 is a roller which presses the roll paper 51 against the conveying roller 61, and which is rotatably provided on the second cover 2. The conveying roller 61 and the pressing roller 62 construct a pair of rollers which rotate while sandwiching the roll paper 51 therebetween to thereby convey the roll paper 51 fed from the roll paper holder 5 in the conveyance direction.

The tensioner 60 is a roller which applies tension to the roll paper 51 at a location between the roll paper holder 5 and the conveying and pressing rollers 61 and 62. The tensioner 60 is rotatably supported on the main body 4.

The conveying belt mechanism 63 is a mechanism in which an endless conveying belt 63C is stretched over a driving belt roller 63A and a driven belt roller 63B. An upper surface of the conveying belt 63C functions as a conveying surface which conveys the roll paper 51. The conveying belt mechanism 63 is provided on the main body 4.

The head 7 has a large number of nozzles on a surface, of the head 7, facing the conveying surface of the conveying belt 63C. The head 7 performs printing by ejecting an UV ink as an example of the "liquid" onto a print surface of the roll paper 51 which is being conveyed on the conveying belt 63C. The head 7 is supported by the main body 4.

The post-processing unit 8 performs a post-processing with respect to the roll paper 51 on which the printing has been performed by the head 7. The post-processing unit 8 includes a UV lamp 81, a table 82, an image reading mechanism 83, and a cutter 84. At least the post-processing unit 8 may be installed in the first cover 1. Note that the post-processing unit 8 may include, as an apparatus which causes the ink to be fixed, a halogen heater, etc., instead of the UV lamp 81; alternatively, the post-processing unit 8 may apply a post-processing liquid by electrophotography so as to assist the fixing of the ink.

The UV lamp 81 is a light source apparatus which irradiates the roll paper 51 with UV light so as to quickly cure the UV ink ejected from the head 7 onto the roll paper 51. The UV lamp 81 is provided on the first cover 1. The UV lamp 81 is arranged so as to extend in a direction orthogonal to the conveyance direction and the second predetermined direction so as to irradiate the UV light in a width direction of the roll paper 51. The table 82 is provided on an upper part of the main body 4 so as to place the roll paper 51 in an area irradiated with UV light by the UV lamp 81.

The image reading mechanism 83 is a mechanism which reads a print image of the roll paper 51 on which the UV ink is fixed by being irradiated with the UV light and for which the printing is completed. The read print image is used for determining whether or not the read print image is normally printed by a processing part constructed of an ASIC (Application Specific Integrated Circuit), etc. The image reading mechanism 83 includes an image reading part 831, a placement plate 832, a first conveying roller 833, a first pressing roller 834, a second conveying roller 835 and a second pressing roller 836.

The image reading part 831 has an image reading sensor which reads an image of the printing surface of the roll paper 51. As this sensor, a well-known image-reading sensor such as a CIS (Contact Image Sensor), etc., is used. The image reading part 831 is provided on the first cover 1. The placement plate 832 is a plate member configured to place the roll paper 51 from which the printed image is read thereon. The placing plate 832 is provided on the upper part of the main body 4.

The first conveying roller 833 is a roller which conveys the roll paper 51 at an entrance position of the image reading part 831. The first conveying roller 833 is rotatably supported on the main body 4 and is driven to rotate by a motor (not depicted in the drawings). The first pressing roller 834 is rotatably provided on the first cover 1. The first pressing roller 834 faces the first conveying roller 833, and presses the roll paper 51 with respect to the first conveying roller 833. The first conveying roller 833 and the first pressing roller 834 sandwich or pinch the roll paper 51 therebetween and rotate so as to convey the roll paper 51 fed from the UV lamp 81 to an image reading area. In the image reading area, the image reading part 831 reads the image of the roll paper 51.

The second conveying roller 835 is a roller which conveys the roll paper 51 at an exit position of the image reading part 831. The second conveying roller 835 is rotatably supported on the main body 4 and is driven to rotate by a motor (not depicted in the drawings). The second pressing roller 836 is rotatably provided on the first cover 1. The second pressing roller 836 faces the second conveying roller 835, and presses the roll paper 51 with respect to the second conveying roller 835. The second conveying roller 835 and the second pressing roller 836 sandwich or pinch the roll paper 51 therebetween and rotate so as to convey the roll paper 51 which is moved out of the image reading area.

The pair of rollers constructed of the first conveying roller 833 and the first pressing roller 834 presses the roll paper 51 at the entrance position of the image reading part 831. On the other hand, the pair of rollers constructed of the second conveying roller 835 and the second pressing roller 836 presses the roll paper 51 at the exit position of the image reading part 831. As a result, the roll paper 51, which is easily curled, is fed into the image reading area in a flat state, and the image reading part 831 can normally read the print image.

The fan 9 guides mist, generated by the UV ink which is ejected from the head 7 but which floats without landing on the roller paper 51, by blowing air, so as to collect the mist. A filter 10A catches and collects the mist guided by the blowing of air by the fan 9. The fan 9 is attached to the first cover 1. The fan 9 is arranged on a lateral side, of the UV lamp 81, in the direction orthogonal to the conveyance direction and the second predetermined direction. Further, the filter 10A is held by the filter holding part 10 so as to be detachable with respect to the first cover 1. The filter holding part 10 and the filter 10A are arranged so as to cover an air introducing side of the fan 9.

The fan 9, the filter 10A, and the filter holding part 10 are provided on the first cover 1. The filter holding part 10 holds the filter 10A so that the filter 10A can be removed toward the downstream side in the conveyance direction in a case that the first cover is allowed to be in the first posture as described above.

Next, the configurations of the first cover 1, the second cover 2, and the main body 4 will be explained in detail. First, the configuration for rotating the first cover 1 and the second cover 2 will be explained. Note that in FIG. 2, the conveyer 6, the head 7, the post-processing unit 8, the fan 9, the filter holding part 10 and the filter 10A are omitted. Further, in FIGS. 3 and 4, although the third cover 3, the conveyer 6, the head 7, the post-processing unit 8, the fan 9, the filter holding part 10 and the filter 10A are omitted, the conveying roller 61 and the pressing roller 62 of the conveyer 6 are depicted.

Figure 2:
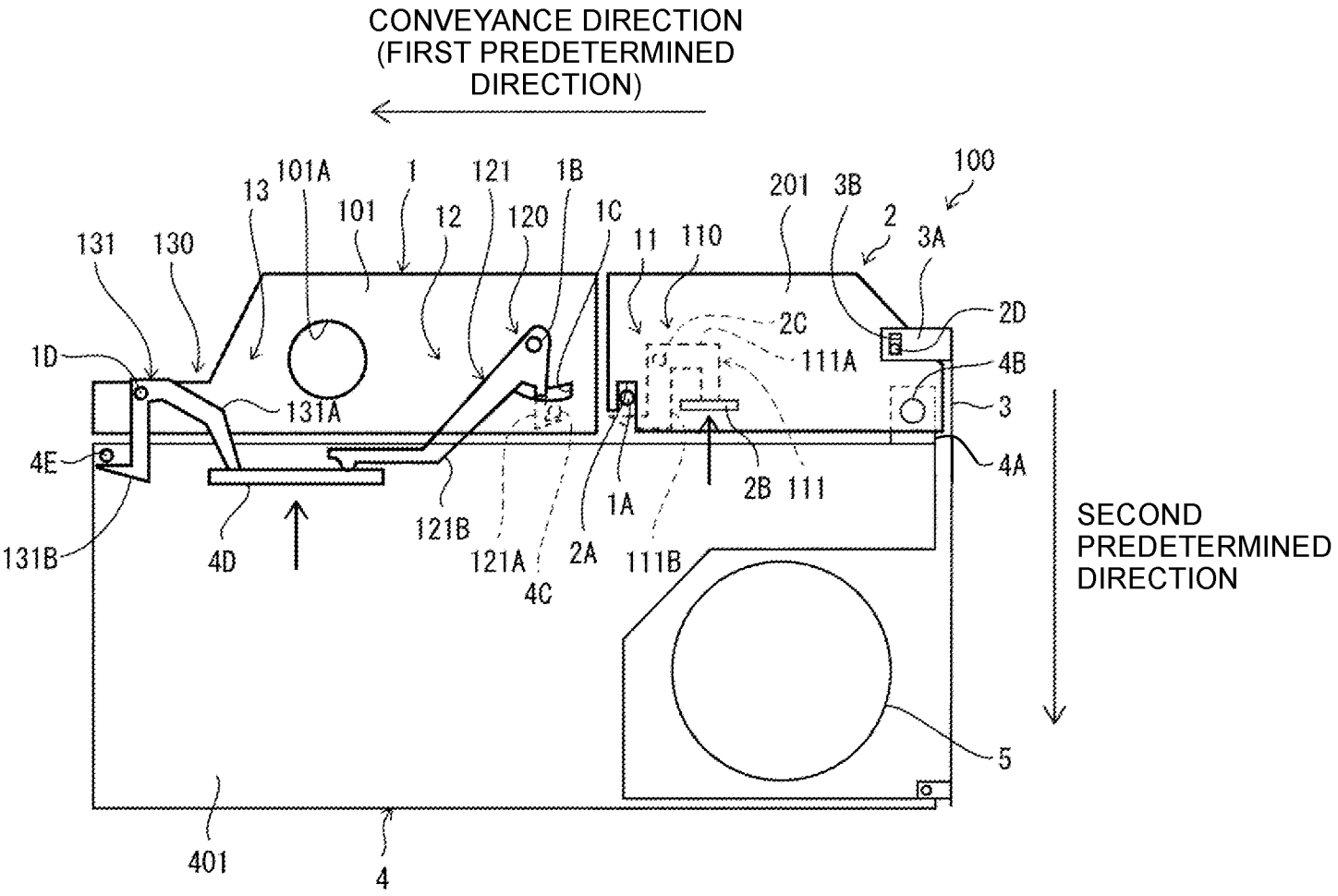
FIG. 2 is a side view depicting the configuration of a first cover, a second cover and a main body of the printing apparatus.
Figure 3:
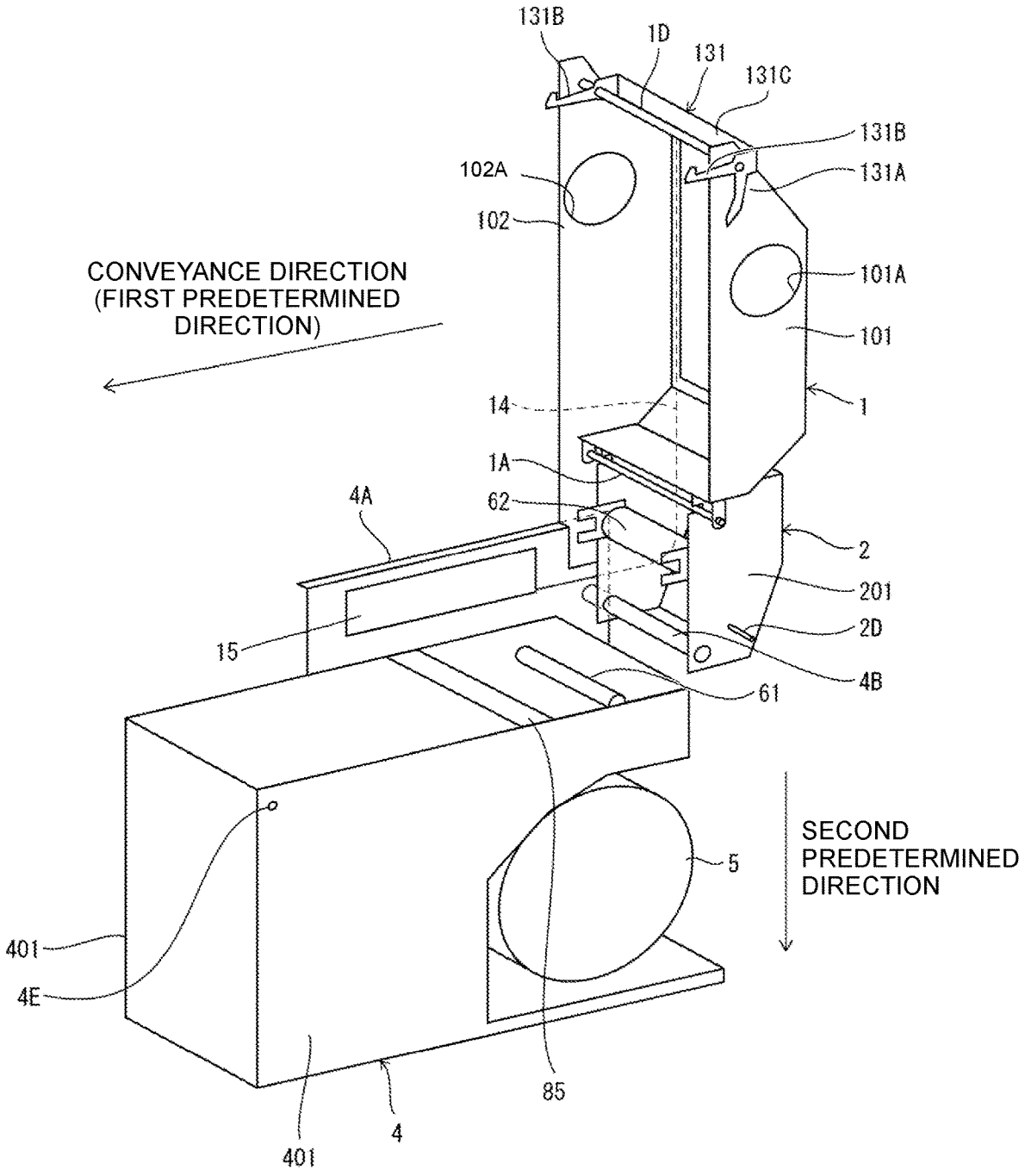
FIG. 3 is a perspective view depicting the configuration of the printing apparatus in a state that the first cover and the second cover are opened.

As depicted in FIG. 3, the main body 4 has a rectangular outer shape as seen thereabove. A rising part 4A is provided on a side edge part on a side of a long side at an upper end part of the main body 4. The rising part 4A is a part having a constant width and formed so as to rise from an upper end of a side wall 401 of the main body 4. Note that in FIG. 2, the rising part 4A is drawn to be small for the sake of convenience.

The rotational shaft 4B is provided on an end part, of the rising part 4A, on a side on which the roll paper holder 5 is provided. The rotational shaft 4B is provided as a cantilevered structure in which one end of the rotational shaft 4B is allowed to be a fixed end which is fixed to the rising part 4A and the other end of the rotational shaft 4B is allowed to be a free end. Further, the rotational shaft 4B extends in the direction orthogonal to the conveyance direction and the second predetermined direction.

As depicted in FIG. 3, the first cover 1 has two side walls 101 and 102 which face each other and which are along the conveyance direction. The side wall 101 has a length from an end part on the downstream side in the conveyance direction of the main body 4 up to a position which is slightly on the upstream side relative to the center in the conveyance direction of the side wall 401 of the main body 4. The side wall 102 has approximately a length which is approximately same as the length in the conveyance direction of the main body 4. The first cover 1 is rotatably supported by the rotational shaft 4B at an end part, of the side wall 102, on the upstream side in the conveyance direction.

The second cover 2 has two side walls 201 which face each other and which are along the conveyance direction. The second cover 2 is rotatably supported by the rotational shaft 4B at end parts, of the side walls 201, on the upstream side in the conveyance direction. The first cover 1 and the second cover 2 are supported coaxially and rotatably with respect to the main body 4 by such a rotational shaft 4B.

Next, an engaging configuration of the first cover 1 and second cover 2 and an engaging configuration of the first cover 1 and the main body 4 will be explained. As depicted in FIG. 2, the printing apparatus 100 includes a first engaging mechanism 11, a second engaging mechanism 12, and a third engaging mechanism 13.

The first engaging mechanism 11 is a mechanism which performs switching of the first cover 1 and second cover 2 to an engaged state and to a disengaged state. The first engaging mechanism 11 is configured to include a rotating mechanism 110, an engaging shaft 1A, a cutout (notch) 2A, and a releasing member 2B.

The engaging shaft 1A is provided on the first cover 1 at an end part thereof which is joined to the second cover 2, namely, at an end part on the upstream side in the conveyance direction of the first cover 1, so that the engaging shaft 1A protrudes to the side of the second cover 2. The engaging shaft 1A is provided parallel to the rotational shaft 4B so as to be extended over the side walls 101 and 102 of the first cover 1.

The cutout (notch) 2A is provided as two cutouts 2A provided on the two side walls 201 of the second cover 2, respectively, which face each other and which are along the conveyance direction. Specifically, each of the cutouts 2A is formed so as to be opened to the side of the main body 4 at an end part, of one of the side walls 201, which engages with the first cover 1, namely, at an end part, of one of the side walls 201, on the downstream side in the conveyance direction. Further, the cutouts 2A are formed at positions at which the cutouts 2A engage with the engaging shaft 1A in a state that the first cover 1 and the second cover 2 are arranged side by side, as depicted in FIG. 2.

The rotating mechanism 110 includes a support shaft 2C and a rotating member 111. The support shaft 2C is provided in parallel with the rotational shaft 4B at a position, in the second cover 2, which is higher than the cutouts 2A and on the upstream side in the conveyance direction with respect to the cutouts 2A. The rotating member 111 is a member which rotates by being rotatably supported by the support shaft 2C. The rotating member 111 is provided on the inside of the second cover 2. The rotating member 111 has two pieces of an arm part 111A and two pieces of a hook 111B corresponding to the two cutout (notch) 2A, respectively.

In a state that the rotating member 111 is engaged with the engaging shaft 1A as depicted in FIG. 2, the arm parts 111A extend from the support shaft 2C in a direction opposite to the conveyance direction, and are bent to further extend toward the main body 4.

In the state that the rotating member 111 is engaged with the engaging shaft 1A as depicted in FIG. 2, the hook parts 111B extend from the support shaft 2C toward the side of the main body 4 and are bent to further extend in the conveyance direction. Further, in the above-described engaged state, a forward end of each of the hook parts 111B closes an open part of one of the cutouts 2A.

The two arm parts 111A and the two hook parts 111B are coupled to be linked to each other by a coupling part (not depicted in the drawings), respectively, inside the second cover 2.

In the first engaging mechanism 11, the forward end of each of the hook parts 111B closes the open part of one of the cutouts 2A in a state that the engaging shaft 1A of the first cover 1 is in the inside of the cutouts 2A in the second cover 2 as depicted in FIG. 2. By holding the engaging shaft 1A by the cutouts 2A and the hook parts 111B, it is possible to obtain the engaged state between the engaging shaft 1A and the rotating member 111, namely, the engaged state between the first cover 1 and the second cover 2.

The releasing member 2B has an operating part which is operated by the user, at the outside of the second cover 2, and has a contacting part which makes contact with an end part of each of the arm parts 111A of the rotating member 111 in the inside of the second cover 2. The releasing member 2B is supported by the second cover 2 so as to be slidable in the up-down direction. For the sake of convenience, only the operating part is depicted in FIG. 2.

In a state that the rotating member 111 is engaged with the engaging shaft 1A as depicted in FIG. 2, the contacting part of the releasing member 2B makes contact with the end part of each of the arm parts 111A. In a case that the user slides the operating part upward from this position, the contacting part of the releasing member 2B is thereby also moved upward. This allows the arm parts 111A of the rotating member 111 to receive a pressing force from the releasing member 2B, and to rotate in a counterclockwise direction in FIG. 2. Then, the forward end of each of the hook parts 111B moves to a position retracted or withdrawn from one of the cutouts 2A. Thus, the engaged state between the rotating member 111 and the engaging shaft 1A is disengaged (released).

After the engaged state is released, in a case that the user releases his or her hand from the operating part of the releasing member 2B, the releasing member 2B descends by its own weight. With this, the rotating member 111 returns to a position, at which the rotating member 11 closes the cutouts 2A, as depicted in FIG. 2.

Note that although the first engaging mechanism 11 is configured to engage with the engaging shaft 1A, which is located in the cutouts 2A, from therebelow by the rotating mechanism 110, the direction of the engagement is not limited to being from below. For example, the rotating mechanism 110 may move in the width direction, of the printing apparatus 100, which is a direction orthogonal to the conveyance direction and the second predetermined direction, and may engage with the engaging shaft 1A. In such a configuration, the engaging shaft 1A is arranged so as to face (to be oriented in) the second predetermined direction.

Further, the first engaging mechanism 11 may have a configuration which is different from the configuration including the rotating mechanism 110, the engaging shaft 1A, the cutouts 2A, and the releasing member 2B. For example, it is allowable to provide, on the two side walls 201 of the second cover 2, two slide shafts to be movable in a reciprocating manner in the conveyance direction and in a direction opposite to the conveyance direction, and to provide, on the side walls 101 and 102 of the first cover 1, a holding structure which supports the slide shafts to be movable. In such a configuration, by sliding the slide shafts in the conveyance direction and by causing the holding structure to hold the slide shafts, it is possible to engage the second cover 2 with the first cover 1.

Other than those described above, the first engaging mechanism 11 may be a mechanism which include a magnet. In such a configuration, the second cover 2 has a magnet, rather than having the rotating mechanism 110, the engaging shaft 1A, the cutouts 2A and the releasing member 2B, and the first cover 1 has a magnet as a counterpart magnet which attracts to the magnet of the second cover 2, rather than engaging with the engaging shaft 1A.

The second engaging mechanism 12 is a mechanism which performs switching of the first cover 1 and the main body 4 to an engaged state and to a disengaged state. The second engaging mechanism 12 is arranged in the first cover 1 at a location closer to the second cover 2 than the center in the conveyance direction of the first cover 1. The second engaging mechanism 12 includes a rotating mechanism 120, an engaging pin 4C, and a releasing member 4D.

The engaging pin 4C is a pin provided integrally with the main body 4. The engaging pin 4C is arranged in the main body 4 at a position close to the side wall 101 of the first cover 1 so as to protrude laterally from an upper end surface of the main body 4. Further, the engaging pin 4C is arranged in the inside of the first cover 1.

The rotating mechanism 120 includes a support shaft 1B and a rotating member 121. The support shaft 1B is provided on the side wall 101 of the first cover 1, at a position which is higher than the engaging pin 4C and which is slightly apart from the engaging pin 4C toward the downstream side in the conveyance direction, so as to protrude from the outer surface of the side wall 101 in a direction parallel to the rotational shaft 4B. The rotating member 121 is a member which rotates by being rotatably supported by the support shaft 1B. The rotating member 121 is provided on the side of the outer surface of the side wall 101 of the first cover 1. The rotating member 121 has a hook part 121A and an arm part 121B.

In a state that the rotating member 121 is engaged with the engaging pin 4C, as depicted in FIG. 2, the arm part 121B extends from the support shaft 1B in an oblique direction toward the downstream side in the conveyance direction and toward the main body 4, and is bent so as to further extend in the conveyance direction.

The hook part 121A is formed to have a bent shape so that the hook part 121A enters into the inside of the first cover 1 via an arc-shaped slit 1C of the first cover 1, from an intermediate part of the hook part 121A. Further, in the state that the rotating member 121 is engaged with the engaging pin 4C, as depicted in FIG. 2, the hook 121A extends from the support shaft 1B toward the side of the main body 4 and is bent so as to further extends in the direction opposite to the conveyance direction. Furthermore, in the case that the rotating member 121 is in the engaged state with the engaging pin 4C as described above, a forward end of the hook part 121A makes contact with a lower end of the engaging pin 4C.

With such a configuration, the second engaging mechanism 12 prevents a movement of the first cover 1 away from the main body 4 in a state that the forward end of the hook part 121A makes contact with the lower end of the engaging pin 4C, as depicted in FIG. 2. Thus, it is possible to obtain the engaged state between the rotating member 121 and the engaging pin 4C, namely, the engaged state between the first cover 1 and the main body 4.

The releasing member 4D is operated by the user and makes contact with an end part of the arm part 121B of the rotating member 121. The releasing member 4D is supported by the side wall 101 of the first cover 1 to be slidable in the up-down direction.

In the case that the rotating member 121 and the engaging pin 4C are in the engaged state as depicted in FIG. 2, the upper surface of the releasing member 4B makes contact with the end part of the arm part 121B. The user slides the releasing member 4D upward from this position, thereby moving the releasing member 4D upward. With this, the arm part 121B of the rotating member 121 receives the pressing force by the releasing member 4D, and the arm part 121B rotates in the clockwise direction in FIG. 2. Then, the forward end of the hook part 121A moves to a position retracted or withdrawn in the conveyance direction. This releases the engaged state between the rotating member 121 and the engaging pin 4C.

After the engaged state is released, in a case that the user releases his or her hand from the releasing member 4D, the releasing member 4D descends by its own weight. Due to the weight balance, the forward end of the rotating member 121 returns to the position of the lower end of the engaging pin 4C depicted in FIG. 2.

The third engaging mechanism 13 is another mechanism which perform the switching of the first cover 1 and the main body 4 to the engaged state and to the disengaged state. The third engaging mechanism is arranged in the first cover 1 at a location close to a downstream-most end part in the conveyance direction of the first cover 1. The third engaging mechanism 13 includes a rotating mechanism 130, engaging pins 4E, and a releasing member 4D. The releasing member 4D is shared by the third engaging mechanism 13 and the second engaging mechanisms 12.

The engaging pins 4E are pins provided integrally with the main body 4. Each of the engaging pins 4E is arranged at a location close to an upper end on the downstream side in the conveyance direction of one of two side walls 401, of the main body 4, which face each other and which are along the conveyance direction. The engaging pins 4E protrude from outer surfaces of the two side walls 401, respectively, in a direction parallel to the rotational shaft 4B.

The rotating mechanism 130 includes a support shaft 1D and a rotating member 131. The support shaft 1D is provided on an end part, of the first cover 1, on the downstream side in the conveyance direction. As depicted in FIG. 3, the support shaft 1D is provided parallel to the rotational shaft 4B so as to be stretched or extended over the side walls 101 and 102 of the first cover 1. The rotating member 131 is a member which rotates by being rotatably supported by the support shaft 1D. The rotating member 131 has an arm part 131A and a hook part 131B.

In a state that the rotating member 131 and the engaging pins 4E are engaged with each other, as depicted in FIG. 2, the arm part 131A is bent so as to extend from the support shaft 1D in an oblique direction toward the upstream side in the conveyance direction and toward the main body 4.

In the state that the rotating member 131 and the engaging pins 4E are engaged with each other, as depicted in FIG. 2, the hook part 131B extends from the support shaft 1D toward the side of the main body 4, and is bent to further extend in the conveyance direction. Further, in the above-described engaged state, the forward end of the hook part 131B makes contact with the lower end of each of the engaging pins 4E.

The arm part 131A and the hook part 131B are provided as two arm parts 131A and two hook parts 131B which are provided on the sides of the outer surfaces of the side walls 101 and 102, respectively, of the first cover 1. As depicted in FIG. 3, a connecting part 131C extends in a direction parallel to the rotational shaft 4B so as to join the two arm parts 131A at parts, of the two arm parts 131A which are in the vicinity of the support shaft 1D.

With such a configuration, the third engaging mechanism 13 prevents a movement of the first cover 1 in a direction away from the main body 4 in a state that a forward end of the hook part 131B makes contact with the lower end of each of the engaging pins 4E, as depicted in FIG. 2. Thus, it is possible to obtain the engaged state between the rotating member 131 and the engaging pin 4E, namely, the engaged state between the first cover 1 and the main body 4.

In a case that the rotating member 131 and the engaging pin 4E are in the engaged state as depicted in FIG. 2, the upper surface of the releasing member 4D makes contact with the end part of each of the arm parts 131A. In a case that the user slides the releasing member 4D upward from this position, the releasing member 4D is thereby moved upward. This allows the arm parts 131A of the rotating member 131 to receive a pressing force from the releasing member 4D, and to rotate in the counterclockwise direction in FIG. 2. Then, the forward end of each of the hook parts 131B moves to a position retracted or withdrawn in the direction opposite to the conveyance direction. Thus, the engaged state between the rotating member 131 and the engaging pin 4E is disengaged (released).

After the engaged state is released, in a case that the user releases his or her hand from the releasing member 4D, the releasing member 4D descends by its own weight. Due to the weight balance, the forward end of the rotating member 131 returns to the position of the lower end of the engaging pin 4E, as depicted in FIG. 2.

Next, a supporting configuration of the third cover 3 will be explained, with reference to FIGS. 5 and 6. Note that in FIGS. 5 and 6, only the second cover 2, the third cover 3, a part of the main body 4, and the rolled paper holder 5 are depicted, and other constituent elements different from those described above are omitted.

As depicted in FIG. 2, the third cover 3 is arranged at end parts on the upstream side in the conveyance direction of the second cover 2 and of the main body 4, respectively. The third cover 3 is formed to have a shape of a rectangular plate. Further, the third cover 3 is rotatably supported at an end part (an example of a "first end part" of the present disclosure), of the main body 4, which is away, in the second predetermined direction, from the first cover 1 and second cover 2 with respect to the center in the second predetermined direction of the main body 4. A lower end of the third cover 3 is rotatably joined to an end part, on the upstream side in the conveyance direction, of a bottom part of the main body 4. Alternatively, the lower end of the third cover 3 may be pivotally supported by the end part at the bottom of the main body 4.

Figure 5:
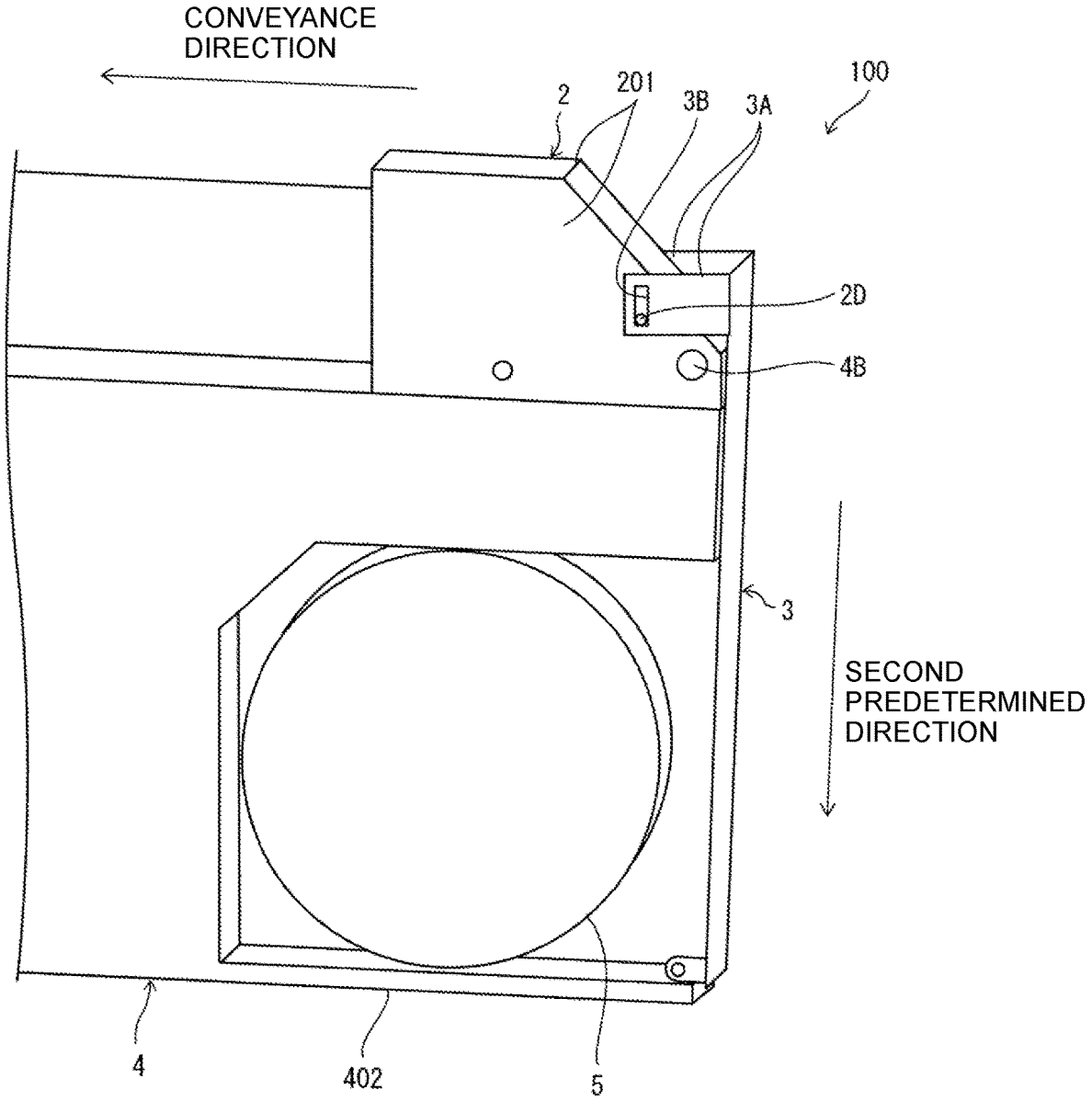
FIG. 5 is a perspective view depicting the configuration of a part of the printing apparatus in a state that the second cover is closed.

As depicted in FIG. 5, an upper end part (an example of a "rotational forward end part" of the present disclosure) of the third cover 3 is held, in the second predetermined direction, by the second cover 2 at a holding position away from the main body 4 with respect to the rotational shaft 4B of the second cover 2. The holding structure for holding the third cover 3 is specifically configured as follows.

Two support parts 3A are provided on both side edges of the upper end part of the third cover 3 so that the two support parts 3A are parallel to each other so as to face each other. Each of the support parts 3A is a plate-shaped part forming a rectangle, and is formed so as to extend in a direction orthogonal to a surface of a body part of the third cover 3. A long hole 3B is formed in an end part, of each of the support parts 3A, which is connected to the second cover 2, the long hole 3B being elongated in a direction orthogonal to the longitudinal direction of each of the support parts 3A.

A pin 2D is formed to protrude from the outer surface of each of the two side walls 201 of the second cover 2 at the holding position, so that the pin 2D protrudes in a direction which is same as the axial direction of the rotational shaft 4B. Note that the holding position is preferably located on the side of the first cover 1 with respect to the rotational shaft 4B.

The pin 2D fitted into the long hole 3B is capable of moving in the inside of the long hole 2B accompanying with the rotation of the third cover 3. This allows the second cover 2 to support the third cover 3, without hindering the rotation of its own.

Figure 4:
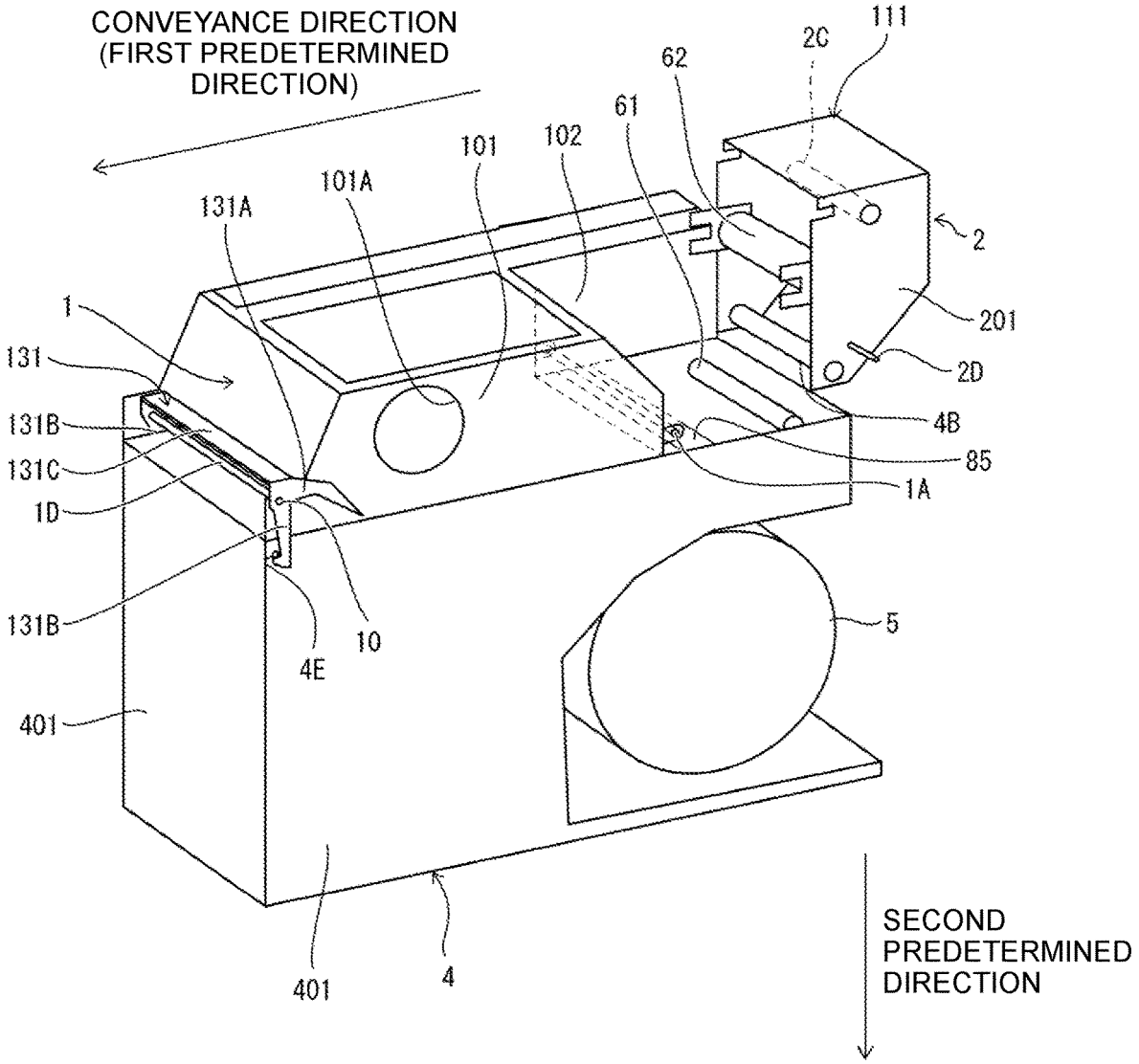
FIG. 4 is a perspective view depicting the configuration of the printing apparatus in a state that the second cover is opened.

Further, another configuration relating to the first cover 1 and the second cover 2 will be explained. Ventilation holes 101A and 102A having a circular-shape are formed in the side walls 101 and 102, respectively, of the first cover 1, as depicted in FIGS. 2 to 4, at positions corresponding to the fan 9 depicted in FIG. 1. The fan 9 generates a flow of air through the ventilation holes 101A and 102A.

As depicted in FIG. 3, the printing apparatus 100 has a wiring 14. The wiring 14 is provided for connecting an electronic component installed in the first cover 1 to a substrate 15 provided on the rising part 4A of the main body 4. The wiring 14 is arranged on the upper surface, of the first cover 1, on a side of the side wall 102, so as to be connected to the electronic component, and the wiring 14 passes via one end part of the first cover 1 which is pivotally supported by the main body 4, reaches the rising part 4A of the main body 4 and thus is connected to the substrate 15.

The electronic component is exemplified by the head 7, the fan 9, the image reading sensor of the image reading part 831, the motor(s) driving the first conveying roller 833 and the second conveying roller 835, the cutter 84, etc. Further, the ASIC as described above, a peripheral circuit of the ASIC, a power source circuit, etc., are installed in the substrate 15.

Here, the rotation(s) of the first cover 1 and the second cover 2 with respect to the main body 4 will be explained, with reference to FIGS. 7 and 8. Note that in FIG. 8, the side wall 102 of the first cover 1 is omitted for the sake of convenience.

As depicted in FIG. 2, in a case that the releasing member 4D is operated by the user in a state that the first cover 1 and the second cover 2 are engaged with each other by the first engaging mechanism 11, the engaged state between the first cover 1 and the main body 4 by the second engaging mechanism 12 and the third engaging mechanism 13 is released. In a case that the end part on the downstream side in the conveyance direction of the first cover 1 is lifted in this state, then as depicted in FIG. 7, the first cover 1 and the second cover 2 are rotated about the rotational shaft 4B, and assume a posture away from the main body 4, namely, an open posture with respect to the main body 4.

In this state, among the post-processing unit 8, the UV lamp 81, the image reading part 831, the first pressing roller 834, the second pressing roller 836 and the cutter 84 are rotated together with the first cover 1, and are away from the conveying path. This allows the conveying path to be such a state that the conveying path is well visible to the user.

On the other hand, in a case that the releasing member 2B is operated by the user in a state that the first cover 1 and the second cover 2 are engaged to each other by the first engaging mechanism 11, as depicted in FIG. 2, the engaged state between the first cover 1 and the second cover 2 by the first engaging mechanism 11 is released. In a case that the end part on the downstream side in the conveyance direction of the second cover 2 is lifted in this state, then as depicted in FIG. 8, the first cover 1 remains on the main body 4, and the second cover 2 is rotated about the rotational shaft 4B, and assumes a posture away from the main body 4, namely an open posture with respect to the main body 4.

Thus, in a case that the first cover 1 is rotated with respect to the main body 4 in the engaged state that the first cover 1 and the second cover 2 are in engaged with each other, it is possible to open and close the first cover 1 and the second cover 2 integrally with respect to the main body 4. Further, in a case that the second cover 2 is rotated with respect to the main body 4 in a state that the first cover 1 is in a closed position with respect to the main body 4 and that the first cover 1 and the second cover 2 are in the non-engaged state in which the first cover and the second cover are not engaged with each other, it is possible to open and close only the second cover 2 with respect to the main body 4.

Thus, in a case of performing the maintenance for the inside of the printing apparatus 100, the first cover 1 and the second cover 2 can be integrally rotated, and in a case of attaching the roll paper 51 to the printing apparatus 100, only the second cover 2 can be rotated. Therefore, satisfactory operability can be realized in both the internal maintenance and the attachment of the roll paper 51.

Further, by providing the second engaging mechanism 12 on the printing apparatus 100, the first cover 1 and the main body 4 are engaged at a position close to the position at which the first cover 1 and the second cover 2 are engaged. This makes it possible to a suppress such a force that causes the engagement location, at which the first cover 1 and the second cover 2 are engaged, to be lifted or floated with respect to the main body 4, by the engagement of the first cover 1 and the main body 4.

Further, in a case that the second cover 2 is in a position to close the main body 4 as depicted in FIG. 5, the upper end part of the third cover 3 approaches closely to the rotational shaft 4B which is the rotational center of the second cover 2. In this state, the distance between the roll paper 51 and the third cover 3 becomes narrow.

Figure 6:
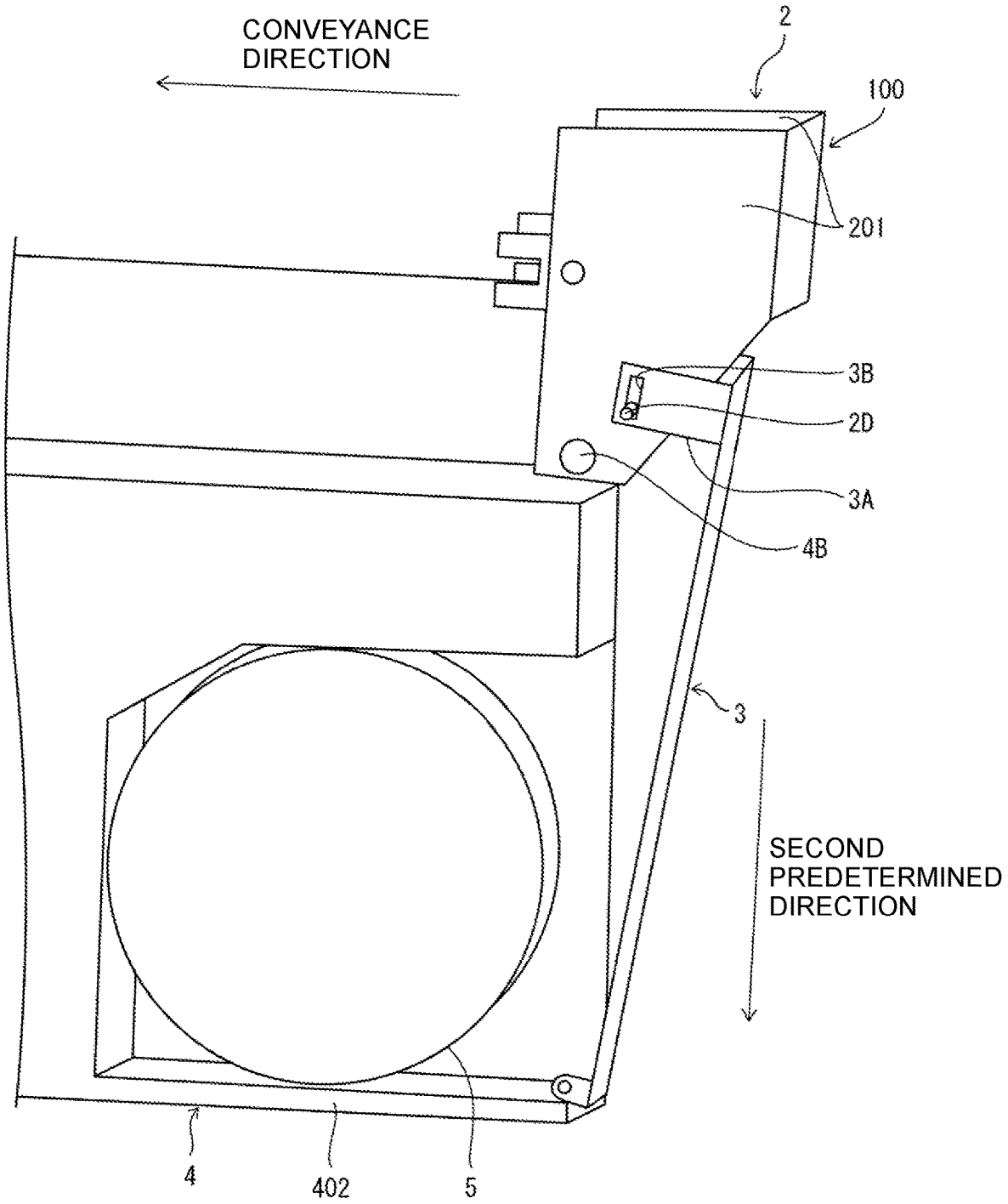
FIG. 6 is a perspective view depicting the configuration of the part of the printing apparatus in the state that the second cover is opened.

On the other hand, in a case that the second cover 2 is in the position at which the second cover 2 opens (releases) the main body 4 as depicted in FIG. 6, the upper end part of the third cover 3 are moved to be away (distant) from the rotational shaft 4B. In this state, the distance between the roll paper 51 and the third cover 3 is widened. As a result, a space for performing an operation of attaching the roll paper 51 to the main body 4, in the state that the second cover 2 is opened, can be secured to be large. Therefore, the roll paper 51 can be easily attached.

Figure 7:
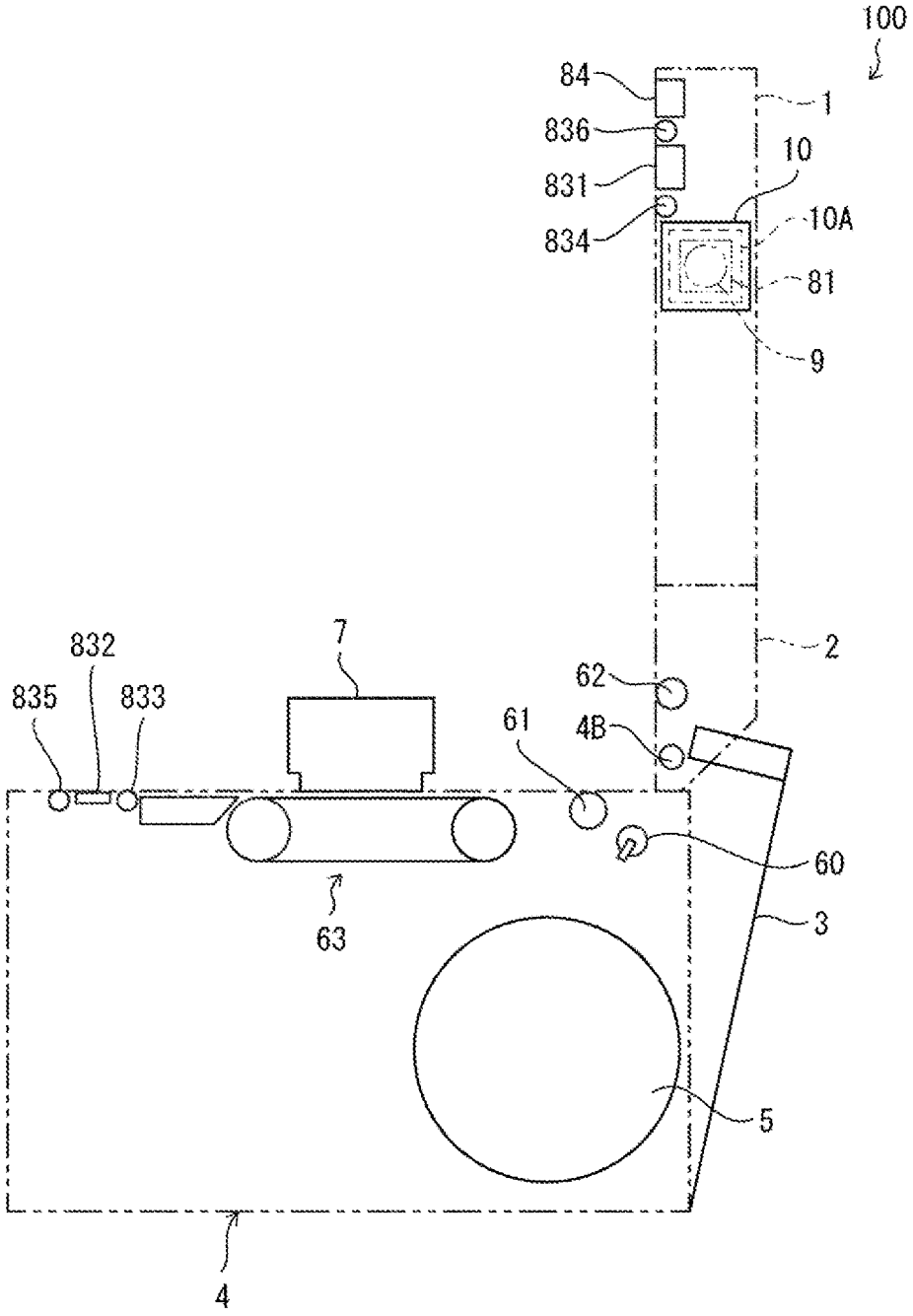
FIG. 7 is a side view depicting the inner configuration of the printing apparatus in the state that the first cover and the second cover are opened.
Figure 8:
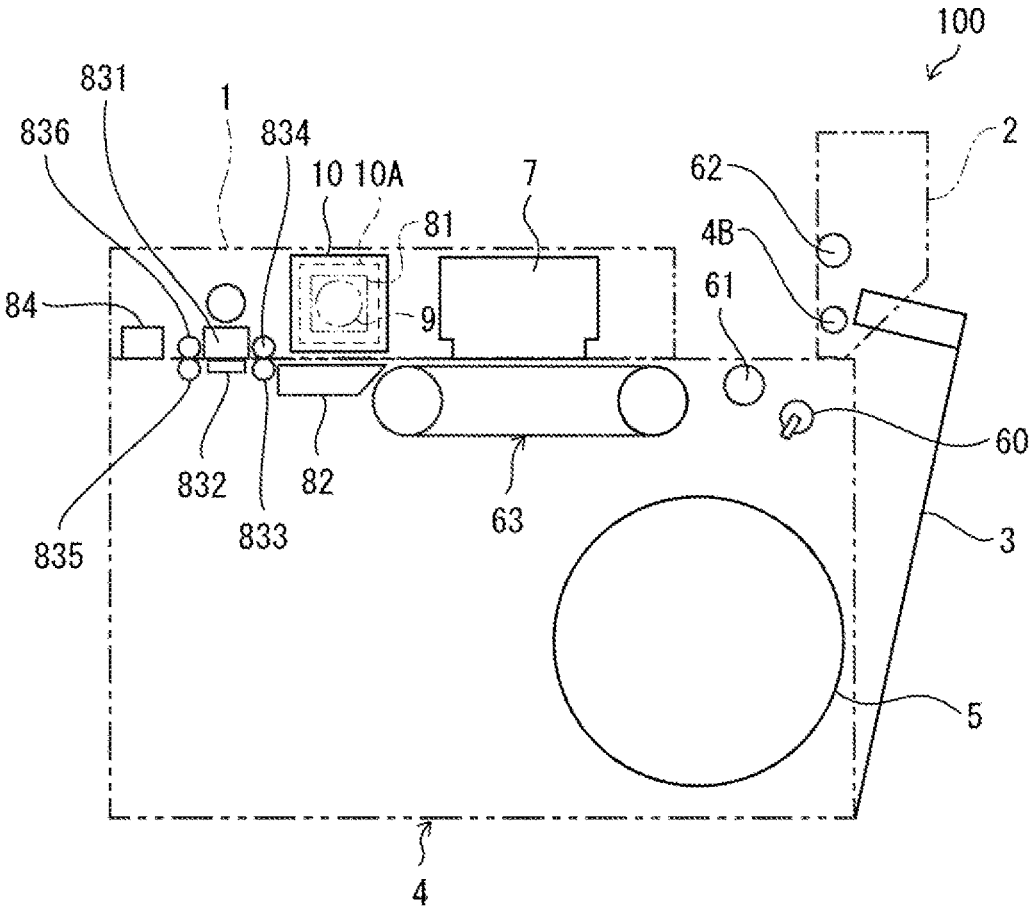
FIG. 8 is a side view depicting the inner configuration of the printing apparatus in the state that the second cover is opened.

Further, in a case that the first cover 1 is in the first posture in which the first cover 1 is away from the main body 4 as depicted in FIG. 7, the filter 10A can be removed from the filter holding part 10 and replaced.

Furthermore, in the printing apparatus 100, the wiring 14 is arranged so as to pass via the one end part of the first cover 1. Thus, as compared with such a configuration that the wiring 14 is arranged so as not to pass via the one end part of the first cover 1, the length of a path of the wiring to the electronic component and the substrate 15 in a case that the first cover 1 is opened and closed is less likely to change, thereby making it possible to prevent the wiring 14 from being detached or disengaged.

Moreover, in the printing apparatus 100, the pressing mechanism includes the conveying roller 61 provided on the main body 4, and the pressing roller 62 provided on the second cover 2. This makes it possible to separate the conveying roller and the pressing roller in a state that the second cover 2 is opened relative to the main body. Therefore, it is possible to easily perform the maintenance of the conveying roller and the pressing roller.

Further, in the printing apparatus 100, the rotational shaft 4B is extended in the direction orthogonal to the second predetermined direction and the conveyance direction. By allowing the first cover and the second cover to rotate about the rotational shaft 4B which is arranged in this manner, it is possible to open and close the first cover and the second cover from the downstream side of the conveyance direction.

Note that in this embodiment, although the explanation has been given about the example wherein the rotational shaft 4B serving as the rotational center of both the first cover 1 and the second cover 2 is extended in the direction orthogonal to the second predetermined direction and the conveyance direction as described above, the direction in which the rotational shaft 4B is extended is not limited to this direction. For example, the rotational shaft 4B may be extended in the conveyance direction. In such a configuration, it is possible to open and close the first cover 1 and the second cover 2 from a direction orthogonal to the second predetermined direction and to the conveyance direction.

Second Embodiment

Figure 9:
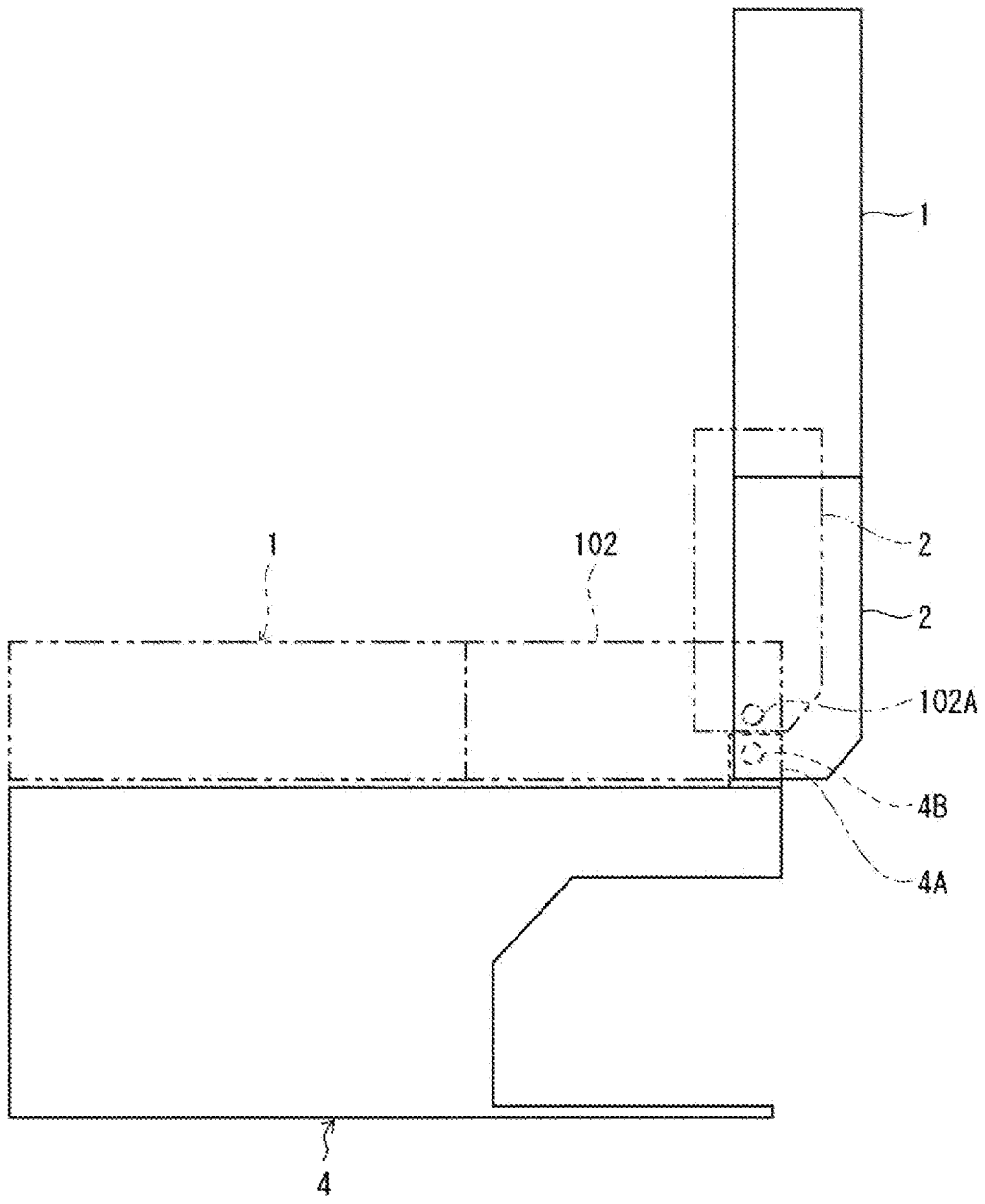
FIG. 9 is a side view depicting a configuration for opening and closing a first cover and a second cover of a printing apparatus according to a second embodiment of the present disclosure.

A second embodiment of the present disclosure will be explained, with reference to FIG. 9. Note that for the sake of convenience, same reference numerals are affixed to constituent elements, of the second embodiment, which have the same functions as those of the constituent elements explained in the first embodiment, and the explanation therefor will not be repeated. Note that in FIG. 9, only the first cover 1, the second cover 2 and the main body 4 are depicted, and the other constituent elements are omitted.

In the printing apparatus 100 of the first embodiment, as depicted in FIG. 7, the first cover 1 and the second cover 2 rotate about the same the rotational shaft 4B as the rotational center. Also in the second embodiment, as depicted in FIG. 9, the side wall 102 of the first cover 1 is supported by the rotational shaft 4B to be rotatable with respect to the rising part 4A of the main body 4, as depicted in FIG. 9. On the other hand, in the second embodiment, the second cover 2 is supported to be rotatable with respect to the first cover 1 by a rotational shaft 102A provided on the side wall 102 of the first cover 1.

Also by such a configuration, in a case that the first cover 1 is rotated with respect to the main body in a engaged state in which the first cover 1 and the second cover 2 are engaged with each other, the first cover 1 and the second cover 2 can be opened and closed integrally with respect to the main body. Further, in a case that the second cover 2 is rotated with respect to the first cover 1 in a state that the first cover 1 is in the closed position with respect to the main body and that the first cover 1 and the second cover 2 are in the non-engaged state in which the first cover 1 and the second cover 2 are not engaged with each other, only the second cover 2 can be opened and closed with respect to the main body.

Thus, in a case that the maintenance is performed for the inside of the printing apparatus 100, it is possible to rotate the first cover 1 and the second cover 2 integrally, and in a case that the roll paper 51 is attached to the printing apparatus 100, it is possible to rotate only the second cover 2. Therefore, the satisfactory operability can be realized in either one of the case of performing the internal maintenance and the case of performing the attachment of the medium.

Third Embodiment

A third embodiment of the present disclosure will be explained below, with reference to FIGS. 1 and 10. Note that for the sake of convenience, same reference numerals are affixed to constituent elements, of the third embodiment, which have the same functions as those of the constituent elements explained in the first and second embodiments, and the explanation therefor will not be repeated.

The printing apparatus 100 of the third embodiment depicted in FIG. 1 is provided with a head of the ink-jet system which discharges or eject an ink, as the head 7. The printing apparatus 100 is not limited to being of the ink-jet printing system, and may be an apparatus adopting the electrophotographic printing system, or adopting a thermal head. In the third embodiment, the printing apparatus 100 provided with the thermal head will be explained.

Figure 10:
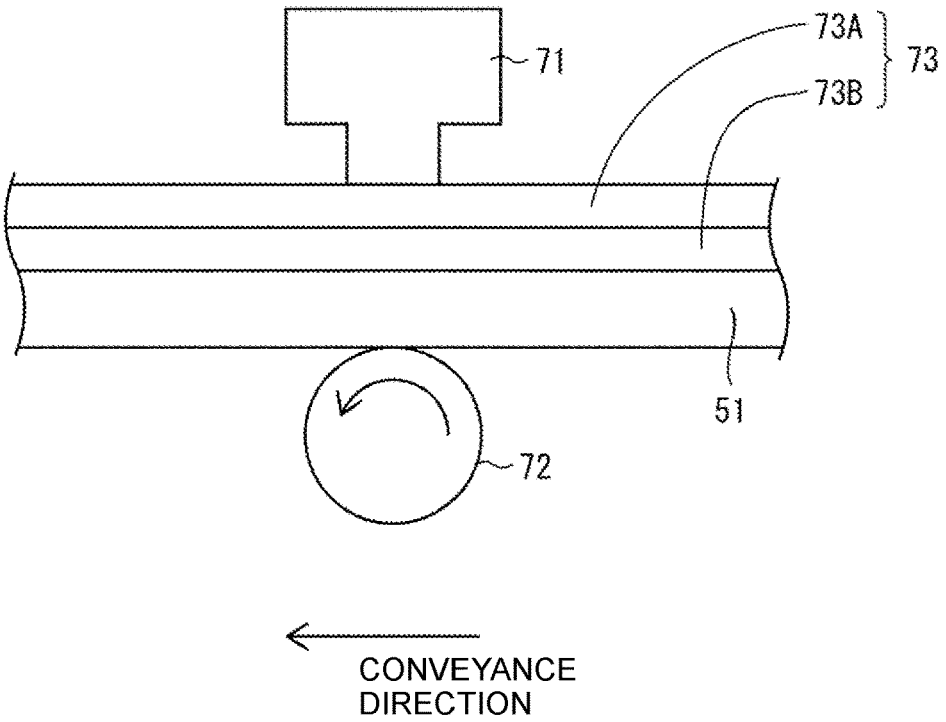
FIG. 10 is a view depicting the configuration of a main part including a head of a printing apparatus according to a third embodiment of the present disclosure.

The printing apparatus 100 of the third embodiment includes, as depicted in FIG. 10, a thermal head 71 as an example of the "printing unit, and a platen roller 72 as an example of the "roller", as depicted in FIG. 10. The thermal head 71 is a head which heats an ink ribbon 73. The ink ribbon 73 is constructed of a base film 73A and an ink 73B which is coated on or applied to the base film 73A.

The platen roller 72 is arranged at a position facing a heating element(s) of the thermal head 71, at a distance from the heating element(s). The platen roller 72 is driven to rotate in a direction of an arrow depicted in FIG. 10. Further, the platen roller 72 sandwiches the ink ribbon 73 and the roll paper 51 between the platen roller 72 and the thermal head 71.

The thermal head 71, which transfers the ink 73B of the ink ribbon 73 to the roll paper 51, and the platen roller 72 also function as a pressing mechanism which presses the roll paper 51.

During printing performed by the printing apparatus 100 having such a configuration, the thermal head 71 and the platen roller 72 conveys the ink ribbon 73 and the roll paper 51 in the conveyance direction in a state that the ink ribbon 73 and the roll paper 51 are sandwiched between the thermal head 71 and the platen roller 72, and the heating elements of the thermal head 71 are selectively and intermittently energized. Thus, the ink 73B of the ink ribbon 73 is transferred to a predetermined area on a surface of the roll paper 51.

Also in the printing apparatus 100 provided with such a thermal head 71, it is possible to allow the first cover 1 and the second cover 2 to rotate with respect to the main body 4 in the engaged state, and it is possible to allow only the second cover 2 to rotate with respect to the main body 4.

Fourth Embodiment

A fourth embodiment of the present disclosure is explained below, with reference to FIG. 3, FIG. 4, FIG. 11 and FIGS. 12A to 12C. Note that for the sake of convenience, same reference numerals are affixed to constituent elements, of the fourth embodiment, which have the same functions as those of the constituent elements explained in the first to third embodiments, and the explanation therefor will not be repeated.

As depicted in FIGS. 3 and 4, the pressing member 85 is provided on the downstream side in the conveyance direction with respect to the conveying roller 61. The pressing member 85 is a member configured to press the roll paper 51 at a desired position, by pressing the roll paper 51 after an end part of the roll paper 51 is installed between the conveying roller 61 and the pressing roller 62. Although FIGS. 3 and 4 depicts an configuration in which the pressing member 85 is provided on the main body 4, it is assumed that, in the first embodiment, the pressing member 85 is not provided on the main body 4. It is assumed that the position of an engaging shaft 1A in the fourth embodiment is different from the position of the engaging shaft 1A as depicted in FIG. 3 and FIG. 4.

Figure 11:
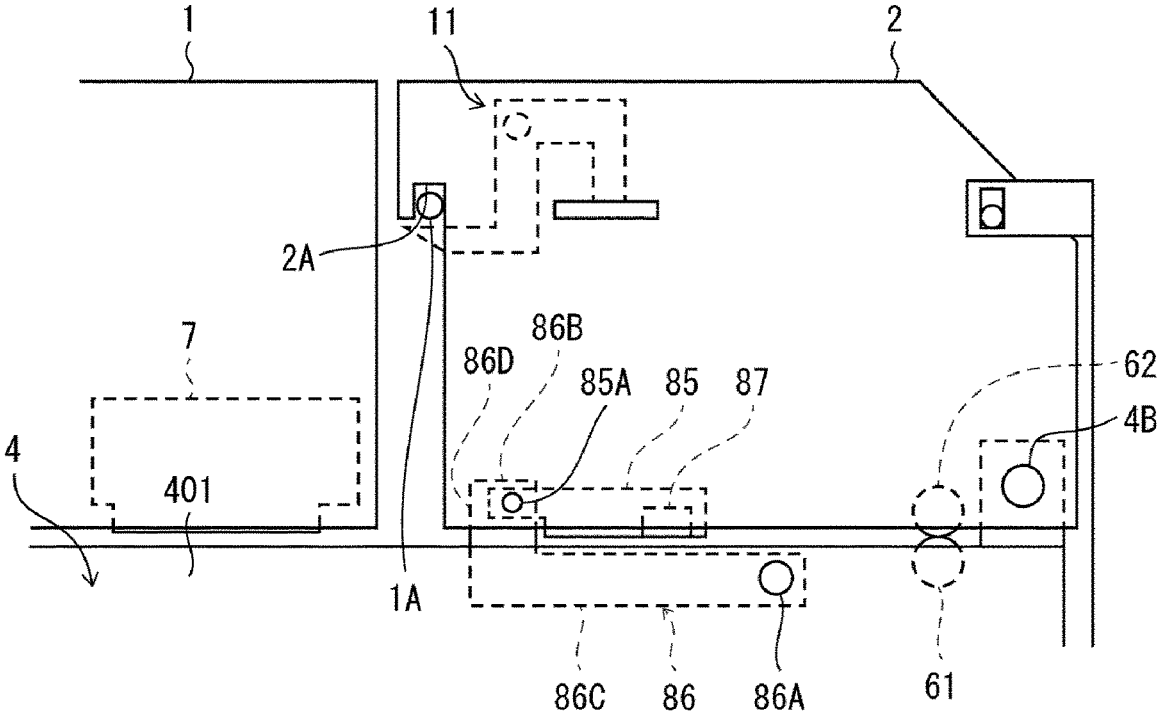
FIG. 11 is a view depicting the configuration in the vicinity of a first cover of a printing apparatus according to a fourth embodiment of the present disclosure.

As depicted in FIG. 11, the printing apparatus includes the pressing member 85, a first rotary shaft 85A, a rotating member 86, a second rotary shaft 86A, and a detecting sensor 87. The pressing member 85 is provided with the detecting sensor 87, and the detecting sensor 87 detects the roll paper 51 which is being conveyed. The pressing member 85 is supported by the rotating member 86 via the first rotary shaft 85A.

The rotating member 86 is provided on each of two side walls 401 of the main body 4 which are extending along the conveyance direction and facing each other. The first rotary shaft 85A is provided to be parallel to the rotational shaft 4B so that the first rotary shaft 85A is stretched or extended over rising parts 86B, of the two pieces of the rotating member 86.

Each of the rotating members 86 is constructed of a rising part 86B and an arm part 86C. In a state that the arm part 86C is accommodated in the inside of the main body 4, the arm part 86C extends in the conveyance direction, and the rising part 86B extends, in a direction opposite to the second predetermined direction, from an end part on the downstream side in the conveyance direction of the arm part 86C. The two rotating members 86 are pivotally supported by the main body 4 via the second rotary shaft 86A. Between the two rotating members 86, a connecting part 86D configured to maintain a certain distance between the two rotating members 86 is connected. The connecting part 86D is provided on a side opposite to the side of the second rotary shaft 86A, with respect to the rising part 86B, and extends in a direction orthogonal to the conveyance direction and to the second predetermined direction.

The second rotary shaft 86A is provided to be parallel to the rotational shaft 4B so as to be stretched or extended over the two side walls 401 of the main body 4. In a state that the arm part 86C of the rotating member 86 is accommodated in the inside of the main body 4, the first rotary shaft 85A and the second rotary shaft 86A are arranged side by side in the conveyance direction, and the first rotary shaft 85A is arranged on the downstream side in the conveyance direction, with respect to the second rotary shaft 86A.

Figure 12A:
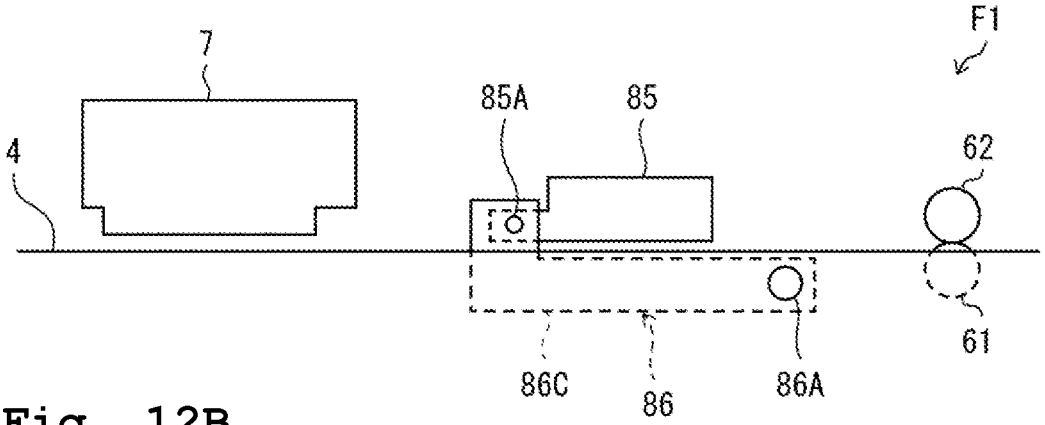
FIGS. 12A to 12C are views depicting the configuration in the vicinity of a pressing member and a rotating member of the printing apparatus.

As indicated by "F1" in FIG. 12A, the pressing member 85 and the rotating member 86 are arranged, in the conveyance direction, between the conveying and pressing rollers 61 and 62 and the head 7. Note that in FIGS. 12A to 12C, for the sake of convenience, the constituent elements which are different from the head 7, the conveying roller 61, the pressing roller 62, the pressing member 85, the first rotary shaft 85A, the rotating member 86 and the second rotary shaft 86A are omitted.

Figure 12B:
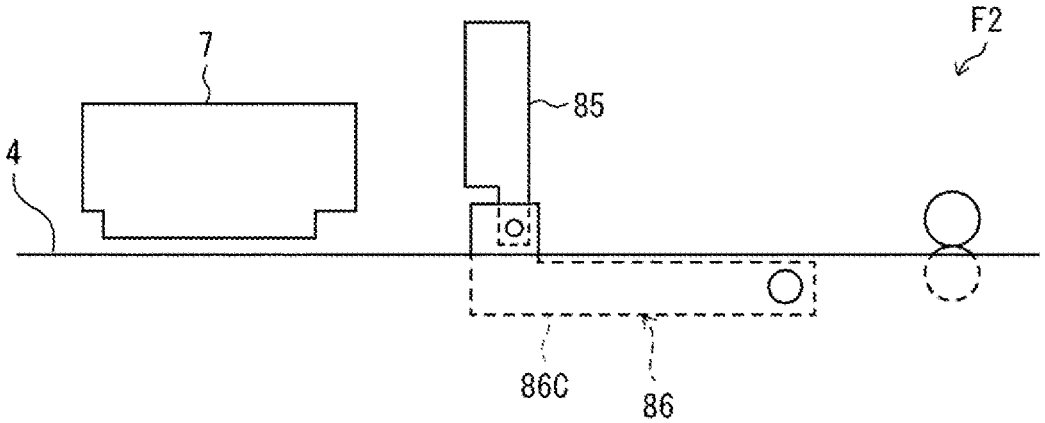

As indicated by "F2" in FIG. 12B, the pressing member 85 is rotated in a counterclockwise direction relative to the rotating member 86. Namely, in a case that the arm part 86C of the rotating member 86 is accommodated in the inside of the main body 4, a part of the pressing member 85 is away from the main body 4 and is moved to approach closely to the head 7.

Figure 12C:
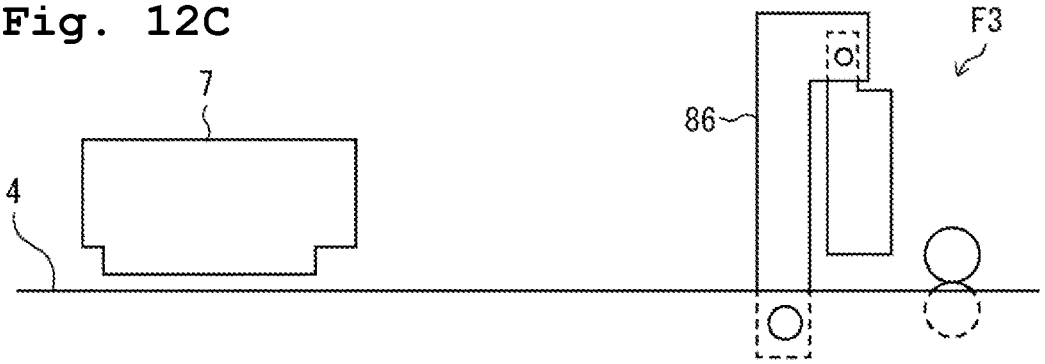

Further, as depicted in "F3" in FIG. 12C, the rotating member 86 is rotated in a clockwise direction with respect to the main body 4. Namely, a part of the rotating member 86 moves in a direction away from the main body 4 and distant from the head 7. Therefore, the direction in which the pressing member 85 is rotated is opposite to the direction in which the rotating member 86 is rotated.

Here, as depicted in FIG. 11, the position of the first engaging mechanism 11 in the fourth embodiment is different from that in the first embodiment. The first engaging mechanism 11 is arranged at a position at which the first engaging mechanism 11 does not make contact with the pressing member 85 and the rotating member 86. According to this, in the fourth embodiment, the position of the engaging shaft 1A and the shape of the cutout (notch) 2A is also different from those in the first embodiment.

Thus, by allowing the second cover 2 to rotate and to rotate the pressing member 85, it is possible to easily attach the roll paper 51 to the printing apparatus 100. Further, by allowing the second cover 2 to rotate and to rotate the rotating member 86, it is possible to easily cope with or take a measure for the paper jam of the rolled paper 51. Therefore, it is possible to realize satisfactory operability in either one of the case of attaching the roll paper 51 and the case of taking the measure for the paper jam.

The present disclosure is not limited to each of the embodiments described above, and various changes can be made within the scope of the claims; an embodiment which is obtained by appropriately combining the technical means disclosed in different embodiments, respectively, is also included in the technical scope of the present disclosure.

What is claimed is:

1. A printing apparatus comprising:

a printing unit configured to perform printing on a medium;

a main body;

a conveyer configured to convey the medium in a conveyance direction;

a post-processing unit configured to perform a post-processing for the medium on which the printing has been performed by the printing unit;

a first cover which is supported by the main body, wherein the first cover is rotatable around an axis;

a second cover arranged to be adjacent to the first cover, the second cover being supported by the main body, wherein the second cover is rotatable around the axis; and an engaging mechanism including a first engaging mechanism part and a second engaging mechanism part, the first engaging mechanism part being provided at an upstream end part of the first cover in the conveyance direction, the second engaging mechanism part being provided at a downstream end part of the second cover in the conveyance direction, the engaging mechanism being configured to change a state of the first cover and the second cover between an engaged state and a non-engaged state, the engaged state being a state in which the first cover and the second cover are engaged with each other by an engagement of the first engaging mechanism part and the second engaging mechanism part, the non-engaged state being a state in which the first cover and the second cover are disengaged by a disengagement of the first engaging mechanism part and the second engaging mechanism part.

2. The printing apparatus according to claim 1, further comprising another engaging mechanism configured to change a state of the first cover and the main body to another engaged state and to another non-engaged state, the another engaged state being a state in which the first cover and the main body are engaged with each other, the another non-engaged state being a state in which the first cover and the main body are disengaged, wherein the first cover and the second cover are arranged side by side in a predetermined direction, and the another engaging mechanism is arranged, in the predetermined direction, on a side of the second cover with respect to a center of the first cover.

3. The printing apparatus according to claim 1, wherein the main body detachably receives the medium, wherein the first cover and the main body are arranged side by side in a predetermined direction, the second cover and the main body are arranged side by side in the predetermined direction, the printing apparatus further comprises a third cover, the third cover is rotatably supported at a first end part of the main body in the predetermined direction, the first end part being located on a side opposite to the first cover and the second cover in the predetermined direction with respect to a center of the main body in the predetermined direction, the medium is installed in the main body as a roll sheet in a state of being wound in a roll shape, in a state that the roll sheet is installed in the main body, an end part of the roll sheet in the predetermined direction is located on a side of the first end part of the main body in the predetermined direction with respect to the center of the main body in the predetermined direction, the roll sheet and the second cover are arranged side by side in the predetermined direction, the third cover has a rotational forward end part which is on a side opposite to a part, of the third cover, which is rotatably supported by the first end part of the main body, and the rotational forward end part of the third cover is held by the second cover at a position on a side opposite to the main body in the predetermined direction, with respect to a rotation center of the second cover.

4. The printing apparatus according to claim 1, wherein the printing unit is configured to perform the printing by discharging liquid onto the medium, the conveyer is configured to convey the medium in the conveyance direction, the first cover has one end part and the other end part in the conveyance direction, the first cover is pivotally supported by the main body at the one end part of the first cover, the first cover is changeable to a first posture in which the other end part is away from the main body and to a second posture in which the other end part is closer to the main body than in the first posture, the printing apparatus further comprises:

a mist collector configured to collect mist generated by discharging the liquid from the printing unit; and a filter holding part provided on the first cover and configured to hold a filter, the filter being configured to catch and collect the mist collected by the mist collector, and the filter holding part is configured to hold the filter such that the filter is capable of being removed in a direction having a component toward a downstream side in the conveyance direction in a state that the first cover is in the first posture.

5. The printing apparatus according to claim 1, further comprising:

an electronic part, for performing the printing, which is installed in the first cover;

a substrate provided on the main body; and a wiring which connects the electronic part and the substrate, wherein the conveyer is configured to convey the medium in the conveyance direction, wherein an end part of the first cover in the conveyance direction is pivotally supported by the main body, and the wiring is arranged such that the wiring extends from the electronic part to the substrate via the end part of the first cover.

6. The printing apparatus according to claim 1, further comprising: a conveying roller provided on the main body and configured to convey the medium; and a pressing roller facing the conveying roller and configured to press the medium to the conveying roller, the pressing roller installed in the second cover.

7. The printing apparatus according to claim 1, wherein the conveyer is configured to convey the medium in the conveyance direction, wherein the first cover and the main body are arranged side by side in a predetermined direction, the second cover and the main body are arranged side by side in the predetermined direction, and wherein the axis extends in a direction orthogonal to the conveyance direction and to the predetermined direction.

8. The printing apparatus according to claim 1, wherein the printing unit is a thermal head which is configured to heat an ink ribbon, and wherein the printing apparatus further comprises a roller which pinches the ink ribbon and the medium between the roller and the thermal head, so as to transfer an ink of the ink ribbon to the medium.

9. A printing apparatus comprising:

a printing unit configured to perform printing on a medium;

a main body;

a conveyer configured to convey the medium in a conveyance direction;

a post-processing unit configured to perform a post-processing for the medium on which the printing has been performed by the printing unit;

a first cover;

a second cover arranged to be adjacent to the first cover and be supported by the main body, wherein the second cover is rotatable, around an axis, together with the first cover; and an engaging mechanism including a first engaging mechanism part and a second engaging mechanism part, the first engaging mechanism part being provided at an upstream end part of the first cover in the conveyance direction, the second engaging mechanism part being provided at a downstream end part of the second cover in the conveyance direction, the engaging mechanism being configured to change a state of the first cover and the second cover between an engaged state and a non-engaged state, the engaged state being a state in which the first cover and the second cover are engaged with each other by an engagement of the first engaging mechanism part and the second engaging mechanism part, the non-engaged state being a state in which the first cover and the second cover are disengaged by a disengagement of the first engaging mechanism part and the second engaging mechanism part.

10. The printing apparatus according to claim 9, further comprising another engaging mechanism configured to change a state of the first cover and the main body between another engaged state and another non-engaged state, the another engaged state being a state in which the first cover and the main body are engaged with each other, the another non-engaged state being a state in which the first cover and the main body are disengaged, wherein the first cover and the second cover are arranged side by side in a predetermined direction, and the another engaging mechanism is arranged, in the predetermined direction, on a side of the second cover with respect to a center of the first cover.

11. The printing apparatus according to claim 9, wherein the main body detachably receive the medium, wherein the first cover and the main body are arranged side by side in a predetermined direction, the second cover and the main body are arranged side by side in the predetermined direction, the printing apparatus further comprises a third cover, the third cover is rotatably supported at a first end part of the main body in the predetermined direction, the first end part being located on a side opposite to the first cover and the second cover in the predetermined direction with respect to a center of the main body in the predetermined direction, the medium is installed in the main body as a roll sheet in a state of being wound in a roll shape, in a state that the roll sheet is installed in the main body, an end part of the roll sheet in the predetermined direction is located on a side of the first end part of the main body in the predetermined direction with respect to the center of the main body in the predetermined direction, the roll sheet and the second cover are arranged side by side in the predetermined direction, the third cover has a rotational forward end part which is on a side opposite to a part, of the third cover, which is rotatably supported by the first end part of the main body, and the rotational forward end part of the third cover is held by the second cover at a position on a side opposite to the main body in the predetermined direction, with respect to a rotation center of the second cover.

12. The printing apparatus according to claim 9, wherein the conveyer is configured to convey the medium in the conveyance direction, wherein the printing unit is configured to perform the printing by discharging liquid onto the medium, the first cover has one end part and the other end part in the conveyance direction, the first cover is pivotally supported by the main body at the one end part of the first cover, the first cover is changeable to a first posture in which the other end part is away from the main body and to a second posture in which the other end part is closer to the main body than in the first posture, the printing apparatus further comprises:

a mist collector configured to collect mist generated by discharging the liquid from the printing unit; and a filter holding part provided on the first cover and configured to hold a filter, the filter being configured to catch and collect the mist collected by the mist collector, and the filter holding part is configured to hold the filter such that the filter is capable of being removed in a direction having a component toward a downstream side in the conveyance direction in a state that the first cover is in the first posture.

13. The printing apparatus according to claim 9, further comprising:

an electronic part, for performing the printing, which is installed in the first cover;

a substrate provided on the main body; and a wiring which connects the electronic part and the substrate, wherein the conveyer is configured to covey the medium in the conveyance direction, wherein an end part of the first cover in the conveyance direction is pivotally supported by the main body, and the wiring is arranged such that the wiring extends from the electronic part to the substrate via the end part of the first cover.

14. The printing apparatus according to claim 9, further comprising a conveying roller provided on the main body and configured to convey the medium, wherein the second cover has a pressing roller facing the conveying roller and configured to press the medium to the conveying roller.

15. The printing apparatus according to claim 9, wherein the conveyer is configured to convey the medium in the conveyance direction, wherein the first cover and the main body are arranged side by side in a predetermined direction, the second cover and the main body are arranged side by side in the predetermined direction, and wherein the axis extends in a direction orthogonal to the conveyance direction and to the predetermined direction.

16. The printing apparatus according to claim 9, wherein the printing unit is a thermal head which is configured to heat an ink ribbon, and wherein the printing apparatus further comprises a roller which pinches the ink ribbon and the medium between the roller and the thermal head, so as to transfer an ink of the ink ribbon to the medium.

* * * * *